US007246684B2

(12) United States Patent
Bean

(10) Patent No.: US 7,246,684 B2
(45) Date of Patent: Jul. 24, 2007

(54) BOOM LIFT VEHICLE AND METHOD OF CONTROLLING BOOM ANGLES

(75) Inventor: Andrew Jay Bean, Greencastle, PA (US)

(73) Assignee: JLG Industries, Inc., McConnellsburg, PA (US)

( * ) Notice: Subject to any disclaimer, the term of this patent is extended or adjusted under 35 U.S.C. 154(b) by 563 days.

(21) Appl. No.: 10/786,157

(22) Filed: Feb. 26, 2004

(65) Prior Publication Data

US 2005/0189179 A1 Sep. 1, 2005

(51) Int. Cl.
*B66F 9/20* (2006.01)

(52) U.S. Cl. ..... 187/224; 182/2.11

(58) Field of Classification Search ..... 187/222, 187/223, 224, 233; 182/2.1–2.11, 63.1, 69.6
See application file for complete search history.

(56) References Cited

U.S. PATENT DOCUMENTS

| | | | | |
|---|---|---|---|---|
| 3,710,368 A | | 1/1973 | Hamilton | |
| 4,063,649 A | | 12/1977 | Hubbard et al. | |
| 4,179,010 A | * | 12/1979 | Ashworth | 182/2.7 |
| 4,188,757 A | * | 2/1980 | Smith, Jr. | 52/111 |
| 5,251,768 A | * | 10/1993 | Yoshimatsu et al. | 212/277 |
| 5,390,104 A | * | 2/1995 | Fulton | 700/65 |
| 5,446,980 A | * | 9/1995 | Rocke | 37/348 |
| 6,488,161 B1 | | 12/2002 | Bean | |
| 6,543,578 B1 | * | 4/2003 | Merz | 182/2.11 |
| 2003/0173151 A1 | | 9/2003 | Bodtke et al. | |

FOREIGN PATENT DOCUMENTS

DE 102 42 270 4/2004

* cited by examiner

*Primary Examiner*—Jonathan Salata
(74) *Attorney, Agent, or Firm*—Nixon & Vanderhye P.C.

(57) ABSTRACT

A boom lift vehicle includes a tower boom pivotally coupled at one end to a vehicle base for tower lift function and rotatable relative to the vehicle base for swing function. A main boom is pivotally coupled to an opposite end of the tower boom for main lift function. A tower boom elevation angle is defined as a maximum allowable tower boom angle relative to the vehicle base for transport. When the tower boom is below the tower boom elevation angle, the main boom angle relative to gravity is maintained at a set point angle, which is determined as the main boom angle (1) at the start of the swing function or vehicle drive, or (2) at a conclusion of the main lift function when combined with at least one of the swing function or vehicle drive. Additional control of the tower boom is effected when the tower boom is above the tower boom elevation angle. In this manner, stability profiles are facilitated while expanding slope requirements of a similar weight vehicle or while maintaining existing slope requirements with a lighter vehicle. The improved boom control additionally provides for safer and smoother operation.

12 Claims, 3 Drawing Sheets

BOOM LIFT VEHICLE AND METHOD OF CONTROLLING BOOM ANGLES

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

The present invention relates to boom lift vehicles and, more particularly, to a boom lift vehicle including a tower boom pivotally coupled with a main boom and a method of controlling lifting functions of the boom lift vehicle.

In designing a boom lift vehicle, vehicle weight is an important consideration affecting manufacturing costs, vehicle maneuverability, safety factors and the like. Boom lift vehicles including one or more articulated booms typically include a strategically-placed counterweight in order to balance moment loads resulting from positions attainable by the boom arms.

Boom lift vehicles are known that include a tower boom pivotally coupled to a vehicle base. The tower boom may also be capable of expansion and retraction via telescope sections. Typically, with conventional arrangements, when raising the tower boom, the tower boom with its telescoped sections fully retracted is first pivoted to a max angle and subsequently extended from the max angle to a max position by extending the telescope sections. By raising the tower boom in this manner, a main boom supporting a platform and pivotally coupled to an upper end of the tower boom may be placed in positions that create a large turning moment. To accommodate such moments, the vehicle must include a large mass counterweight to stabilize the machine. Such larger counterweights, however, increase manufacturing costs and may have a detrimental affect on operating envelopes, for example, when the vehicle is operated on an incline. Additionally, vehicles exceeding a certain weight limit require special permits for transporting via public roads. This added consideration results in still higher costs to the vehicle purchaser.

In previous arrangements, forward stability positions are most critical when the main boom is extended near a horizontal angle and when the tower is fully raised in angle but fully retracted in length. Backward stability conditions are most critical when the main boom is fully raised when the tower is lowered and retracted or when the tower is fully raised and fully extended. Allowable positions of the tower other than these end points gain backward stability margin at the expense of forward stability margin as described above.

An articulated machine typically includes an upright and a means to maintain the upright in the vertical position when raising the tower either by an upright level cylinder or mechanical linkages. This is done to transfer the reference angle of the turntable or ground for platform leveling, to reduce the total stroke of the main boom lift cylinder and to avoid the main boom lift cylinder from having the capability of positioning the main boom into positions of backward instability.

U.S. Pat. No. 6,488,161 describes advantages of using the tower and main boom as counterweight by limiting the positions of both forward and backward stability, particularly when the tower is raised from 68 to 72 degrees when the main boom is raised from 15 to 55 degrees. By reducing the horizontal outreach of the machine, a destabilizing moment of the upper boom and platform load is reduced. Such a construction also enables the weight of the boom structure to be in the most favorable position to aid in the counterbalancing of the upper boom and platform load destabilizing moment.

In previous machines, the working envelopes of the booms were mechanically limited. When these machines were operated on sloping ground, the ultimate angle of the booms was a function of the mechanical limits of the machine and the angle of the ground. This effectively tilts the working envelope by the actual ground slope, increasing and decreasing the reach of the platform from the base of the machine. The increased angles of the boom detracted from the stability of the machine and therefore resulted in the addition of counterweight.

BRIEF SUMMARY OF THE INVENTION

The present invention controls boom angles in a boom lift vehicle in order to facilitate stability profiles and expand slope requirements for machine operation on an incline. The boom control configuration of the invention provides for safer and smoother operation.

Moreover, in this arrangement, the previous most critical forward stability position has been eliminated as the tower cannot be fully raised without being fully extended. Forward stability has been improved without the reduction of backward stability as the two extreme tower positions remain. The remaining portion of the tower path has been optimized for backward stability margins. In addition, this machine has no upright due to electronic platform leveling (which eliminates the need for maintaining the reference to the ground); the total stroke of the main boom is accomplished at the linkage of the main lift cylinder, and the main boom backward stability is controlled by the control system using sensors to measure the boom position. Still further, in this machine, the angle of the tower and main booms are preferably measured relative to gravity, thus eliminating the effect of ground slope on the working envelope, and thereby reducing the counterweight needed to stabilize the machine.

In an exemplary embodiment of the invention, a method of controlling boom angles in a boom lift vehicle is provided. The boom lift vehicle includes a tower boom pivotally coupled at one end to a vehicle base for tower lift function and rotatable relative to the vehicle base for swing function. A main boom is pivotally coupled to an opposite end of the tower boom for main lift function. The method includes defining a tower boom elevation angle as a maximum allowable tower boom angle relative to the vehicle base for transport, and controlling the main boom when the tower boom is below the tower boom elevation angle to maintain a main boom angle relative to gravity at a first set point angle. The first set point angle is determined as the main boom angle (1) at a start of the swing function or vehicle drive, or (2) at a conclusion of the main lift function when combined with at least one of the swing function or vehicle drive.

The main boom may include telescoping sections for main telescope function. In this context, the method may further include controlling the tower boom when the tower boom is above the tower boom elevation angle to maintain a tower boom angle relative to gravity at a second set point angle. The second set point angle is determined as the tower boom angle (1) at a start of the main lift function, the main telescope function, the swing function or vehicle drive, or (2) at a conclusion of the tower lift function when combined with at least one of the main lift function, the main telescope function, the swing function or vehicle drive.

The method may still further include, prior to the controlling step, sensing an angle of the main boom relative to gravity. In this context, the sensing step includes measuring an angle of the tower boom relative to gravity, determining a relative position of the tower boom and the main boom, and determining the main boom angle relative to gravity based on the measured angle and the relative position.

In another exemplary embodiment of the invention, a method of controlling boom angles in a boom lift vehicle includes the steps of defining a tower boom elevation angle as a maximum allowable tower boom angle relative to the vehicle base for transport; and controlling the main boom when the tower boom is below the tower boom elevation angle and when performing at least one of the swing function, the main telescope function, or vehicle drive, where the controlling step is practiced by adjusting a main boom angle relative to gravity to reduce effects of changes to the main boom angle.

In this context, the method may further include controlling the tower boom when the tower boom is above the tower boom elevation angle and when performing at least one of the main lift function, the main telescope function, the swing function or vehicle drive, where the controlling step is practiced by adjusting a tower boom angle relative to gravity to reduce effects of changes to the tower boom angle.

In still another exemplary embodiment of the invention, a boom lift vehicle includes a vehicle base, a tower boom, and a main boom. The tower boom is pivotally coupled at one end to the vehicle base for tower lift function and rotatable relative to the vehicle base for swing function. The main boom is pivotally coupled to an opposite end of the tower boom for main lift function. A control system controls positions of the tower boom and the main boom.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figures 1, 2:
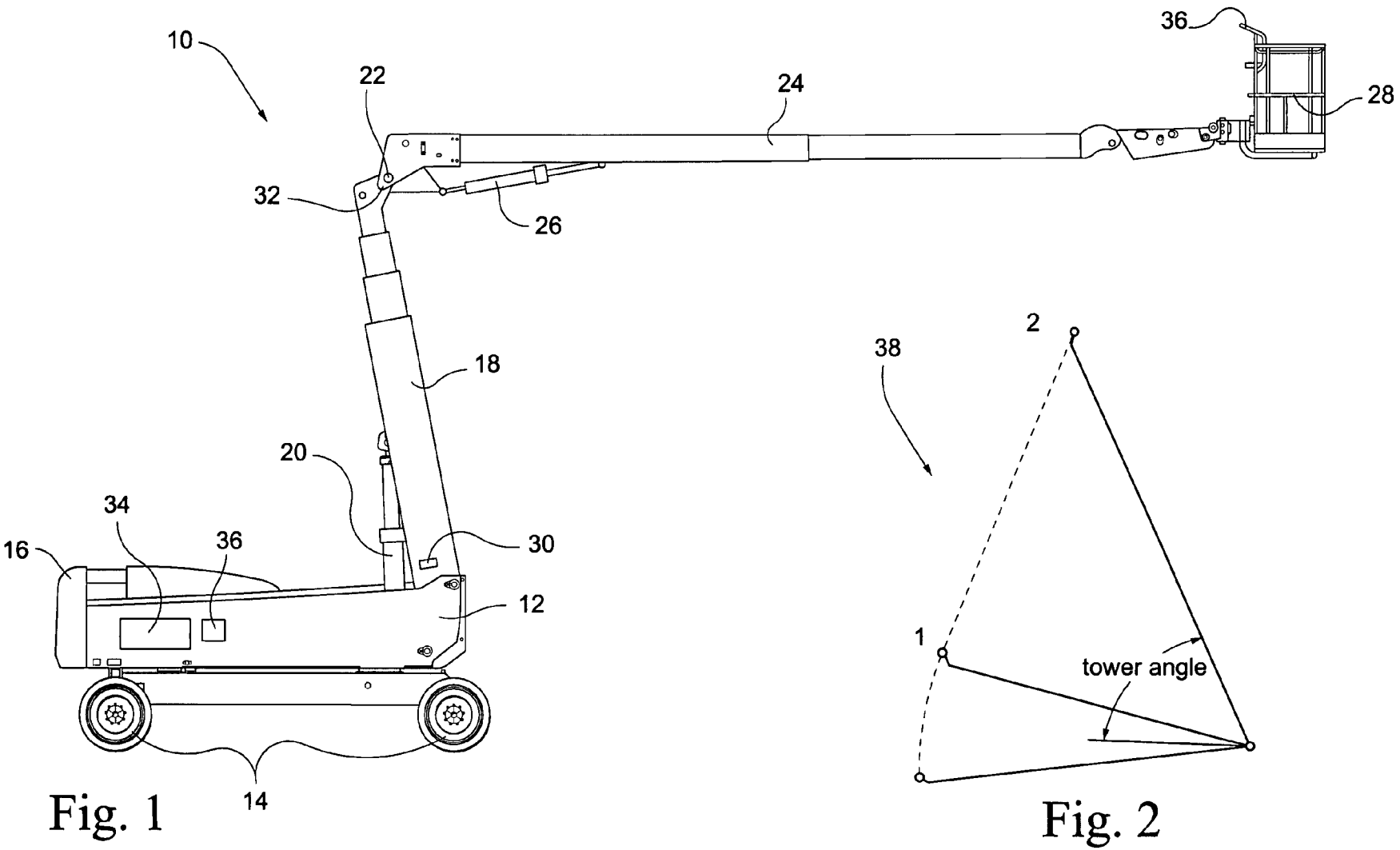
FIG. 1 is a schematic illustration of a boom lift vehicle.
FIG. 2 illustrates the controlled tower boom path of the invention.

With reference to FIG. 1, a boom lift vehicle 10 generally includes a vehicle base 12 supported by a plurality of wheels 14. A counterweight 16 is fixed to the vehicle base 12 to counterbalance turning moments generated by the vehicle boom components. The vehicle base 12 also houses suitable drive components coupled with the vehicle wheels 14 for driving the vehicle.

A telescoping tower boom 18 is pivotally coupled at one end to the vehicle base 12. A lifting member 20 such as a hydraulic cylinder is disposed between the tower boom 18 and the vehicle base 12 for effecting tower lift functions. The tower boom 18 includes telescope sections that are coupled with suitable driving means (not shown) to effect telescope extend/retract functions. A nose pin 22 of the tower boom is disposed at an uppermost end of the tower boom 18 opposite the end pivotally attached to the vehicle base 12.

A main boom 24 is pivotally coupled to the tower boom 18 at the tower boom nose pin 22. A suitable lifting mechanism 26 such as a hydraulic cylinder drives a position of the main boom 24 relative to the tower boom 18. The main boom 24 may also include telescope sections coupled with a suitable driving mechanism (not shown) to effect telescope functions of the main boom 24.

A platform 28 is pivotally secured to an outermost end of the main boom 24.

As shown in FIG. 1, in contrast with conventional articulating boom lift vehicles, the tower boom 18 and the main boom 24 are preferably without a conventional upright between them. Typically, an upright between articulating booms serves to maintain the orientation of, for example, the main boom as the tower boom is raised. The boom lift vehicle 10 of the present invention eliminates such an upright and rather utilizes sensing structure for sensing an angle of the main boom, preferably relative to gravity. In particular, an inclinometer 30 is attached to the tower boom 18 for measuring an angle of the tower boom 18 relative to gravity. A rotation sensor 32 is coupled between the tower boom 18 and the main boom 24 for determining a relative position of the tower boom 18 and the main boom 24. A control system 34 controls lift and telescope functions of the tower boom 18 and the main boom 24. Outputs from the inclinometer 30 and the rotation sensor 32 are processed by the controller 34, and the main boom angle relative to gravity can thus be determined. Alternatively, an inclinometer may be coupled directly with the main boom 24.

The control system 34 controls tower lift and telescope functions in order to control a path of the tower nose pin 22 through a predetermined path. A tower length sensor communicates with the control system 34 to determine a telescoped length of the tower boom 18. A single control switch shown schematically at 36 in FIG. 1 effects raising and lowering of the tower boom, and the control system 34 automatically controls tower lift and telescope functions to follow the predetermined path depending on the main boom angle. A control switch 36 is provided at the vehicle base 12 and for passenger control in the platform 28.

Figure 3:
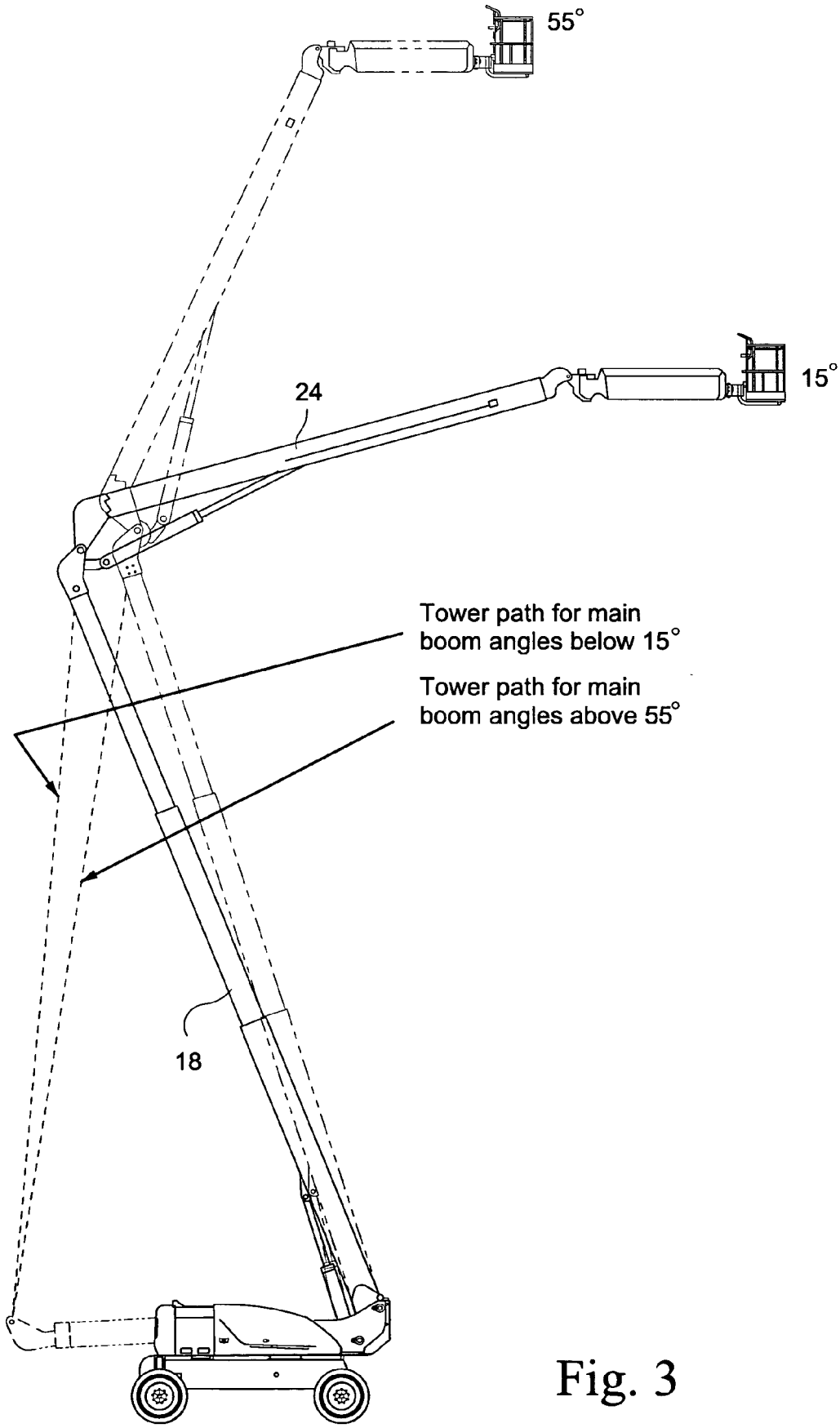
FIG. 3 shows the tower boom path varying based on main boom angle.

FIG. 2 illustrates the nominal tower boom path controlled via the control system 34. The tower path is a fixed relationship of tower length and tower angle (preferably relative to gravity) and is variable only by the angle of the main boom 24. In an exemplary arrangement, with main boom angles below +15°, the tower boom 18 will reach maximum angles of 68° (at full tower boom extension) and with main boom angles above +55°, the tower boom 18 will reach maximum angles of 72° (at full tower boom extension). FIG. 3 schematically illustrates differences in the tower path with different main boom angles. For angles between +15° and +55°, the control system 34 will interpolate to determine the desired tower path.

Movement of the main boom 24 will cause the control system 34 to adjust the tower path accordingly. A fully raised tower boom 18 will automatically vary in angle from 72° to 68° as the main boom 24 is lowered from its maximum angle to the ground and conversely be raised from 68° to 72° as the main boom 24 is raised from the ground to maximum angle. The amount of tower angle variation during main boom 24 movements diminishes as the tower 18 is lowered.

With continued reference to FIG. 2, in contrast with the conventional systems wherein a tower boom is first raised to its max angle before any telescoping function, the control system 34 controls the path 38 of the tower nose pin 22 by simultaneously controlling pivoting of the tower boom 18 relative to the vehicle base 12 and telescoping of the tower boom 18. In this manner, the controlled nominal tower boom path shown in FIG. 2 can be effected, whereby the tower boom 18 can be raised to its max position considerably faster than with conventional arrangements. Pivoting of the tower boom 18 relative to the vehicle base 12 and telescoping of the tower boom 18 are controlled such that the nose pin 22 predetermined path follows (1) a constant radius equal to a fully retracted length of the tower boom 18 for tower boom angles (+/−) less than a predetermined angle determined relative to gravity, and (2) a substantially straight line tangent to the constant radius for tower boom angles greater than the predetermined angle. Preferably, the predetermined angle is about 6.6°. Thus, as can be seen in FIG. 2, in a preferred arrangement, at angles less than +/−6.6°, the tower boom 18 is fully retracted so that the tower boom 18 is only pivoted along a constant radius. See, for example, the arc path between a tower boom 18 lowermost position and position '1'. As the tower boom 18 passes through 6.6° relative to gravity, pivoting of the tower boom 18 relative to the vehicle base 12 and telescoping of the tower boom 18 are performed simultaneously so that the nose pin 22 follows a substantially straight line tangent to the constant radius. See, for example, the noted path between points '1' and '2'.

In operation, the control system 34 additionally controls an angle of the main boom 24 relative to the tower boom 18 based on a position of the tower boom 18. The control system 34 uses envelope control sensors to enhance the control of the main boom 24 during tower lift functions. Due to the mechanical joining of the main 24 and tower 18 booms, changes in tower boom angle would normally have an opposite effect on the main boom angle. To compensate for this, when the tower 18 is raised, the control system 34 automatically introduces main lift up. Similarly, when the tower 18 is lowered, the control system 34 automatically introduces main lift down. This is done to keep the platform moving in same direction as the user command and to increase user efficiency during tower lift functions.

An angle of the main boom 24 relative to the tower boom 18 is controlled by maintaining the main boom angle, preferably relative to gravity, as measured at (1) the commencement of a tower lift control or (2) a conclusion of a main boom lift command when the main boom 24 is active with a tower lift command. When tower lift down is commanded, the control system 34 maintains the main boom angle according to the noted parameters unless the minimum angle with respect to the tower 18 has been reached, at which point the minimum angle with respect to the tower boom 18 is maintained.

Figure 4:
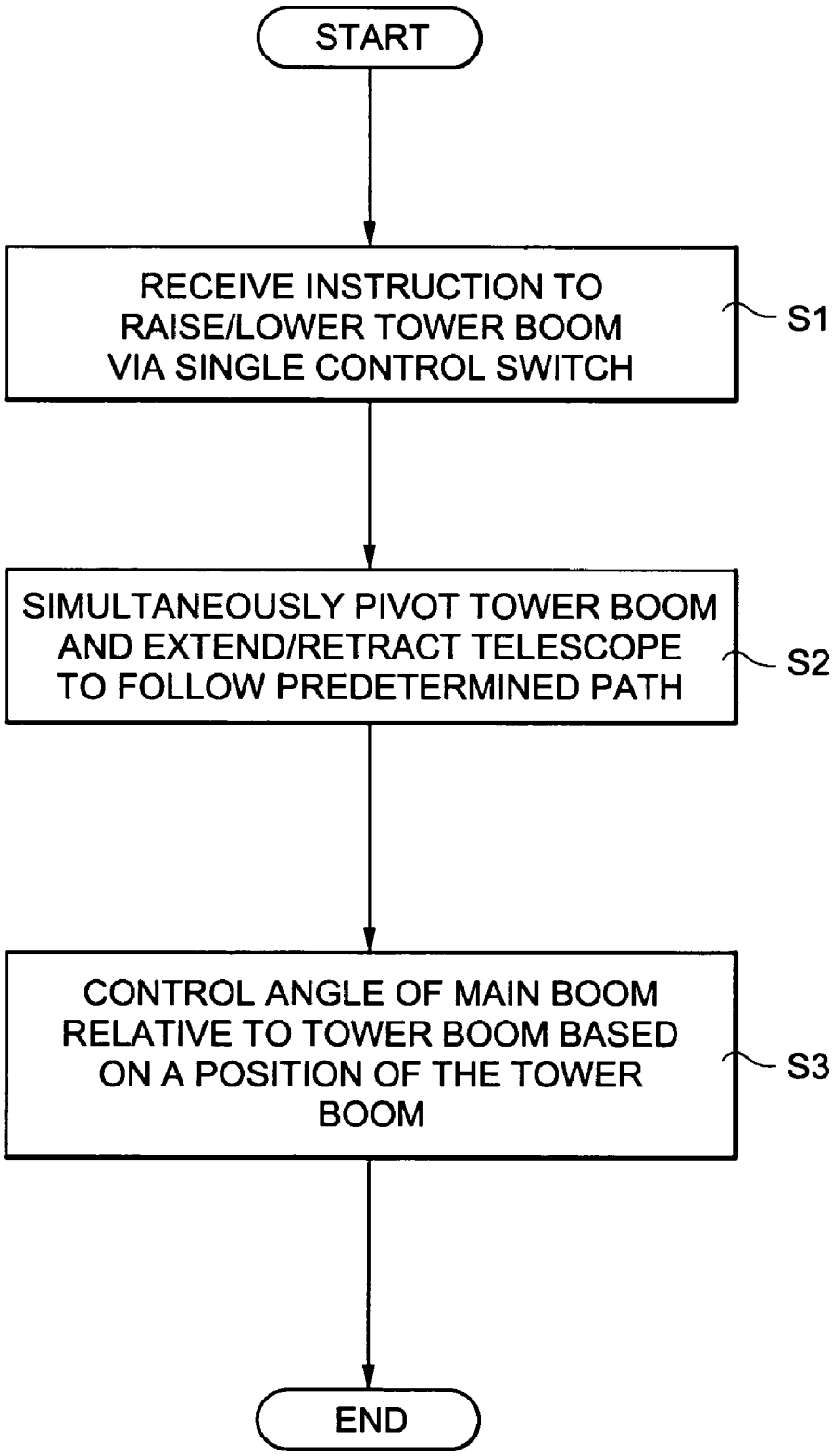
FIG. 4 is a flow chart of a method for controlling the tower boom.

FIG. 4 is a flow chart showing the method of the present invention. In operation, in step S1, the control system 34 receives an instruction to raise/lower the tower boom 18 via the single control switch 36. The control system 34 simultaneously pivots the tower boom 18 and extends/retracts the telescope sections to follow a predetermined path (step S2). During this operation, the angle of the main boom 24 relative to the tower boom 18 is controlled based on a position of the tower boom 18 (step S3).

The control system 34 uses sensors to enhance the control of the booms by minimizing the interaction of swing and drive functions with envelope edges. This interaction is due to two factors. First, the envelope is controlled preferably relative to gravity regardless of ground slope, and second, the turntable/boom mounting (of the tower boom 18 to the vehicle base 12) is effected by swing and drive functions when the ground slope varies. This can cause the boom position to vary within the envelope or even violate the envelope edges when swinging or driving without intentionally moving the boom. The controlled boom angle system minimizes this effect by automatically introducing either the tower 18 or main boom 24 lift up or down during swing and drive commands to maintain a constant boom angle relative to gravity.

A tower boom elevation angle is defined as a maximum allowable tower boom angle relative to the vehicle base for transport. When the tower boom 18 is below the tower elevation angle and the main boom 24 is 25° above the tower boom 18, the angle of the main boom 24 is controlled. When the tower boom 18 is above the tower elevation angle, the angle of the tower boom 18 is controlled regardless of main boom 24 position. Just as the booms are controlled during swing and drive functions, the tower angle is also controlled during main boom lift and main boom telescope functions.

In this context, the control system 34 controls the main boom 24 when the tower boom 18 is below the tower boom elevation angle to maintain a main boom angle relative to gravity at a first set point angle. The first set point angle is determined as the main boom angle (1) at a start of the swing function or vehicle drive, or (2) at a conclusion of the main lift function when combined with at least one of the swing function or vehicle drive. When the tower boom 18 is above the tower boom elevation angle, the control system 34 controls the tower boom 18 to maintain a tower boom angle relative to gravity at a second set point angle. The second set point angle is determined as the tower boom angle (1) at a start of the main lift function, the main telescope function, the swing function or vehicle drive, or (2) at a conclusion of the tower lift function when combined with at least one of the main lift function, the main telescope function, the swing function or vehicle drive.

By controlling the tower path according to the present invention, a boom lift vehicle is prevented from reaching positions of maximum turning moment as in conventional constructions. As a consequence, the mass of the counterweight can be significantly reduced, thereby reducing manufacturing costs and facilitating transport of the boom lift vehicle. Additionally, the predetermined path of the tower boom nose pin is controlled using a single switch, and by simultaneously pivoting the tower boom relative to the vehicle base and telescoping the tower boom, the tower boom can reach its max position considerably faster than conventional two-stage tower lifting operations.

With the controlled boom angles, stability profiles are facilitated while expanding slope requirements of a similar weight vehicle or while maintaining existing slope requirements with a lighter vehicle. The improved boom control additionally provides for safer and smoother operation.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of controlling boom angles in a boom lift vehicle, the boom lift vehicle including a tower boom pivotally coupled at one end to a vehicle base for tower lift function and rotatable relative to the vehicle base for swing function, and a main boom pivotally coupled to an opposite end of the tower boom for main lift function, wherein an angle relative to gravity is irrespective of the vehicle base or ground slope, the method comprising:

defining a tower boom elevation angle as a maximum allowable tower boom angle relative to the vehicle base for transport; and controlling the main boom when the tower boom is below the tower boom elevation angle to maintain a main boom angle relative to gravity at a first set point angle when performing the swing function, during vehicle drive, and both when performing the swing function and during vehicle drive, the first set point angle being determined as the main boom angle (1) at a start of the swing function or vehicle drive, or (2) at a conclusion of the main lift function when combined with at least one of the swing function or vehicle drive.

2. A method according to claim 1, wherein the main boom includes telescoping sections for main telescope function, the method further comprising controlling the tower boom when the tower boom is above the tower boom elevation angle to maintain a tower boom angle relative to gravity at a second set point angle, the second set point angle being determined as the tower boom angle (1) at a start of the main lift function, the main telescope function, the swing function or vehicle drive, or (2) at a conclusion of the tower lift function when combined with at least one of the main lift function, the main telescope function, the swing function or vehicle drive.

3. A method according to claim 1, further comprising, prior to the controlling step, sensing an angle of the main boom relative to gravity.

4. A method according to claim 3, wherein the sensing step comprises measuring an angle of the tower boom relative to gravity, determining a relative position of the tower boom and the main boom, and determining the main boom angle relative to gravity based on the measured angle and the relative position.

5. A method of controlling boom angles in a boom lift vehicle, the boom lift vehicle including a tower boom pivotally coupled at one end to a vehicle base for tower lift function and rotatable relative to the vehicle base for swing function, and a telescoping main boom pivotally coupled to an opposite end of the tower boom for main lift function and main telescope function, the method comprising:

defining a tower boom elevation angle as a maximum allowable tower boom angle relative to the vehicle base for transport; and controlling the main boom when the tower boom is below the tower boom elevation angle and when performing at least one of the swing function, the main telescope function, or vehicle drive, the controlling step being practiced by adjusting a main boom angle relative to gravity to reduce effects of changes to the main boom angle.

6. A method according to claim 5, further comprising controlling the tower boom when the tower boom is above the tower boom elevation angle and when performing at least one of the main lift function, the main telescope function, the swing function or vehicle drive, the controlling step being practiced by adjusting a tower boom angle relative to gravity to reduce effects of changes to the tower boom angle.

7. A method according to claim 5, further comprising, prior to the controlling step, sensing an angle of the main boom relative to gravity.

8. A method according to claim 7, wherein the sensing step comprises measuring an angle of the tower boom relative to gravity, determining a relative position of the tower boom and the main boom, and determining the main boom angle relative to gravity based on the measured angle and the relative position.

9. A boom lift vehicle comprising:

a vehicle base;

a tower boom pivotally coupled at one end to the vehicle base for tower lift function and rotatable relative to the vehicle base for swing function;

a main boom pivotally coupled to an opposite end of the tower boom for main lift function; and a control system controlling positions of the tower boom and the main boom, the control system defining a tower boom elevation angle as a maximum allowable tower boom angle relative to the vehicle base for transport, wherein the control system is configured to control the main boom when the tower boom is below the tower boom elevation angle to maintain a main boom angle relative to gravity at a first set point angle when performing the swing function, during vehicle drive, and both when performing the swing function and during vehicle drive, wherein an angle relative to gravity is irrespective of the vehicle base or ground slope, the first set point angle being determined as the main boom angle (1) at a start of the swing function or vehicle drive, or (2) at a conclusion of the main lift function when combined with at least one of the swing function or vehicle drive.

10. A boom lift vehicle according to claim 9, wherein the main boom comprises telescoping sections for main telescope function, and wherein the control system is further configured to control the tower boom when the tower boom is above the tower boom elevation angle to maintain a tower boom angle relative to gravity at a second set point angle, the second set point angle being determined as the tower boom angle (1) at a start of the main lift function, the main telescope function, the swing function or vehicle drive, or (2) at a conclusion of the tower lift function when combined with at least one of the main lift function, the main telescope function, the swing function or vehicle drive.

11. A boom lift vehicle according to claim 10, further comprising means for sensing an angle of the main boom relative to gravity.

12. A boom lift vehicle according to claim 11, wherein the sensing means comprises:

an inclinometer attached to the tower boom, the inclinometer measuring an angle of the tower boom relative to gravity; and a rotation sensor coupled between the tower boom and the main boom, the rotation sensor determining a relative position of the tower boom and the main boom, wherein the control system determines the main boom angle relative to gravity based on output from the inclinometer and the rotation sensor.

* * * * *